United States Patent [19]

Bing et al.

[11] 4,143,298

[45] Mar. 6, 1979

[54] TELEVISION CATHODE RAY TUBE HAVING A VOLTAGE DIVIDER PROVIDING TEMPERATURE-INVARIANT VOLTAGE AND ASSOCIATED METHOD

[75] Inventors: Valentijn B. Bing, Des Plaines; James W. Schwartz, Deerfield, both of Ill.

[73] Assignee: Zenith Radio Corporation, Glenview, Ill.

[21] Appl. No.: 829,765

[22] Filed: Sep. 1, 1977

[51] Int. Cl.[2] ..... H01J 29/96

[52] U.S. Cl. ..... 315/3; 313/450; 315/52

[58] Field of Search ..... 315/3, 46, 52, 59, 309; 358/190; 323/69; 313/450

[56] References Cited

U.S. PATENT DOCUMENTS

| | | | |
|---|---|---|---|
| 2,771,566 | 11/1956 | Baracket | 315/59 X |
| 3,299,316 | 1/1967 | Wollrich | 315/52 |
| 3,932,786 | 1/1976 | Campbell | 315/3 |

*Primary Examiner*—Eugene R. LaRoche
*Attorney, Agent, or Firm*—Ralph E. Clarke

[57] ABSTRACT

An improved internal voltage divider for use in a television cathode ray tube is disclosed that provides one or more temperature-invariant voltages. The tube is subject to internal spatial temperature patterns fixed or varying with time which are incidental to tube warm-up and operation. The voltage divider according to the invention is comprised of at least two electrically series connected resistive sections having like temperature coefficients, and having resistive values of the same order of magnitude. Each section is so positioned and arranged relative to the aforesaid temperature patterns as to have similar average temperature experiences. The voltage divider is connected between a relatively high anode voltage and a suitable low-voltage terminal for receiving a relatively low voltage through the base of the tube. Means are provided for tapping off at least one temperature-invariant intermediate voltage. Due to the similiarity of the spatial average temperature experiences of the resistive sections comprising the voltage divider, the ratio of the resistive values of the resistive sections, and thus the ratio of voltage drops thereacross does not change despite variations in the temperature patterns. An associated method provides for positioning and arranging the discrete sections comprising the voltage divider.

6 Claims, 19 Drawing Figures

TELEVISION CATHODE RAY TUBE HAVING A VOLTAGE DIVIDER PROVIDING TEMPERATURE-INVARIANT VOLTAGE AND ASSOCIATED METHOD

CROSS REFERENCE TO RELATED PATENT APPLICATIONS

This application is related to but in no way dependent upon copending applications of common ownership herewith, including Ser. No. 649,630 filed Jan. 16, 1976 now abandoned; Ser. No. 655,592 filed Feb. 6, 1976 now abandoned; Ser. No. 666,858 filed Mar. 15, 1976 now U.S. Pat. No. 4,058,753; Ser. No. 694,614 filed June 10, 1976 now abandoned; Ser. No. 736, 791 filed Oct. 29, 1976 now U.S. Pat. No. 4,063,340; Ser. No 811,494 filed June 30, 1976, and Ser. No. 830,270 filed Sept. 2, 1977.

BACKGROUND AND PRIOR ART STATEMENT

This invention relates generally to an improved internal voltage divider structure for a television cathode ray tube. In its present preferred implementation, the voltage divider supplies one or more voltages intermediate to the high voltage of the ultor anode, and the relatively lower voltages introduced through the base of the tube. This invention has applicability to tubes of many types in construction, but is believed to be most advantageously applicable in color television cathode ray tubes having electron guns with extended field focus lenses requiring a plurality of focus lens potentials. The intermediate voltages supplied by the voltage divider according to the invention may also supply potentials to electrodes within the cathode ray tube other than gun electrodes, such as a focus mask electrode.

Electron guns of the type referred to in the foregoing may comprise a series of discrete, electrically conductive discs or tubular elements contiguous to each other and aligned on a common axis. In multi-gun assemblies, each gun may comprise a series of electrically discrete electrodes, or, the electrodes of gun which have functions in common may be physically combined, or "unitized." The electrodes receive voltages of a predetermined potential to establish electrostatic fields therebetween for forming and shaping the beam, and, in the main focus lens, for focusing the beam crossover to provide small, symmetrical "spots" on the viewing screen. The electron guns having extended field lenses of a certain type may require one or more selected potentials in the range of approximately eight to fifteen kilovolts or higher; these voltages are designated herein as "intermediate" to the relatively high ultor anode voltage of twenty-five to thirty-two kilovolts, and the relatively lower voltages in the one to eight kilovolt range introduced through the base of the cathode ray tube. If the said intermediate potential is brought into the tube through the base as shown, for example, in U.S. Pat. No. 3,995,194, such a tube cannot readily be installed in a television chassis having no provision for supplying such potentials; for example, a television chassis designed for a tube incorporating a gun with a bipotential lens requiring only relatively low and relatively high operating voltages as defined in the foregoing.

As noted, the aforesaid intermediate potential is commonly introduced into the envelope of the cathode ray tube through the base of the tube along with the relatively low voltages. The introduction of a potential of the magnitude cited through the base can engender serious problems. A major problem is a tendency toward destructive arcing in the base area due to the close spacing of high-voltage leads in the base, and, in the neck of the tube.

The structure and relationship of an electron gun and cathode ray tube, and the prior art means for supplying operating voltages to the combination, is shown by FIG. 1. The primary components of a typical color picture tube 10 comprise an evacuated envelope including a neck 12, a funnel 14 and a faceplate 16. On an inner surface of the faceplate 16 are deposited a multiplicity of cathodoluminescent phosphor target elements 18 comprising a pattern of groups of red-light-emitting, green-light-emitting, and blue-light-emitting dots or stripes. A perforated electrode 20 called a "shadow mask," is used in the tube for color selection. Base 22 provides entrance means for a plurality of electrically conductive lead-in pins 24.

An electron gun 26, illustrated schematically, is disposed within neck 12 substantially as shown. Gun 26 is commonly installed in axial alignment with a center line X—X of picture tube 10. Gun 26 emits one or more electron beams 28 to selectively activate target elements 18.

Power supply 30, also shown schematically, provides voltages for operation of the cathode ray tube and its electron gun. To supply the required potentials, a special voltage divider circuit is typically incorporated into the external power supply circuit. Power supply 30 may supply relatively low voltages in the one to eight kilovolt range through one or more leads represented schematically by 32, which enter the envelope of tube 10 through the plurality of lead-in pins 24 in base 22. Power supply 30 may also supply selected intermediate voltages to the focus electrodes of electron gun 26, voltages typically in the range of eight to fifteen kilovolts or higher; these voltages are shown as being supplied to the electrodes within the envelope of tube 12 by way of lead-in pins 24 through lead 33. The relatively high voltage for electron gun operation; that is, a voltage typically in the range of twenty-five to thirty-two kilovolts for excitation of the accelerating anodes, is indirectly supplied to gun 26 through lead 34, which is connected to anode button 36. Anode button 36 in turn introduces the high voltage through the glass envelope of funnel 14, making internal contact with a thin, electrically conductive coating 38 disposed on the internal surface of funnel 14, and part-way into neck 12. The anode electrode of gun 26 receives the relatively high anode voltage through a plurality of metallic gun centering springs 40 extending from gun 26 and in physical contact with inner conductive coating 38.

The introduction of the selected intermediate voltages described heretofore into the cathode ray tube envelope 10 through lead-in pins 24 has presented serious problems in prior art cathode ray tube technology. Introduction of such high voltages through the lead-in pins has typically required an elaborate socket, indicated schematically by 42 in combination with base 22 and associated lead-in pins 24. The close adjacency of lead-in pins 24, and the wide range of potentials thereon (from a few volts to many kilovolts) has made it necessary to devise tube socket-base combinations capable of shielding the lead-in pins one from the other. Isolation means have included insulative barriers or walls molded as part of the socket and base to extend prospective arc paths. Sockets have also comprised non-destructive arcing paths in their structure, and arc-quenching means embodied in the socket and base combination. It has also often been necessary to introduce potting compounds into the tube base to eliminate arc-prone air paths between leads. This complexity of the socket and base combination adds to manufacturing costs.

In U.S. Pat. No. 3,932,786 to Campbell, there is disclosed a voltage divider in conjunction with a bipotential electron gun for a television cathode ray tube. Comprising a single short resistive element, the voltage divider is shown as being mounted on one of the two glass support rods of the gun. The single resistive element of the voltage divider is electrically connected between the first and second accelerating and focus electrodes of the bipotential main focus lens. The resistive element has a series of six taps which are connected to six electrode plates successively spaced between first and second focus electrodes of the gun. The plates are electrically connected by means of electrical taps to the resistive element at points of successively greater resistance with respect to the end attached to the first focus electrode of the gun.

The composition and the operating requirements of the single resistive element according to Campbell are described as follows (quoting from column 2, lines 62–68, and column 3, lines 1 and 2): "Resistor 50 is a thin cermet film 49 deposited on a substrate 51 which is bonded to one of the glass support rods 28. In order to operate within the cathode ray tube, the resistor 50 must have a very small temperature coefficient of resistivity and must be able to withstand a high voltage (approximately 32,000 volts) that is applied to the second electrode 26."

The temperature coefficient of resistivity (resistance-temperature characteristic) is defined as the magnitude of change in resistance due to temperature, usually expressed in percent per degree Celsius or parts per million per degree centigrade (ppm° C.). (*Reference Data for Radio Engineers, Howard W. Sams & Co., Inc.*, 1970.) A large temperature coefficient implies a large change in resistance for a given change in temperature, while a small coefficient implies a small change. A small temperature coefficient is desirable in a resistor used as a voltage divider as the tapped-off voltage will, as a result, vary only minimally as a result of temperature change.

However, the environment within a cathode ray tube is one of wide temperature variance. When not operating, the temperature of the electron gun components in the neck of a cathode ray tube, for example, may be at the normal ambient temperature of about 22° C. Following tube turn-on, the pattern of temperature distribution in the neck of the cathode ray tube will be fixed or will vary with time as a consequence of tube warm-up and operation, with the maximum temperature approaching 100° C.

The effect of temperature differences on a single-resistive-element voltage divider comprised of cermet results in a substantial variation in resistance due to temperature change, and hence, a substantial temperature dependence in the potential at each tap-off point. The temperature coefficient of resistivity of a typical cermet material may be relatively large, e.g., ~500 ppm° C. Although lower values are attainable from certain special materials available in the art, they require great care in processing to avoid wide variations in performance.

The single resistive element comprising the Campbell voltage divider is shown as being quite short in relation to the axial length of the electron gun. A short resistive element offers the advantage of being relatively unaffected by temperature differences that may exist along the length of the gun. There are, however, marked, offsetting disadvantages inherent in a short resistor length. One disadvantage lies in the fact that the voltage per unit length is very large; e.g., twenty-eight kilovolts across the short resistive path of the Campbell voltage divider. Another disadvantage stems from the fact that there must be an appreciable current through the voltage divider so that stray currents do not alter the division ratio. A typical current would be 60 microamperes. Assuming twenty-eight kilovolts across the Campbell resistor, the resistor would have to dissipate about one and a half watts or more. Because of the short length of the resistor and its small mass, the resistive element could well become intolerably hot.

For the reasons given, the performance of a voltage divider having a single resistive element according to Campbell is considered to be not adequate for developing temperature-invariant voltages in a cathode ray tube, particularly in high voltage applications.

Generally with regard to the temperature dependence of electronic components, the problem of locating such components so as not to be adversely affected by a nearby heat-generating component, is recognized in microcircuit technology. The problem is described in chapter 13, pages 184–185 of *Electronic Integrated Systems Design*, by H.R. Camenzind. (New York: Van Nostrand Rhinehold, 1972). The problem is said to be especially significant in devices such as transistors which are expected to match. Camenzind suggests placing sensitive matching devices as far away from the heat source as possible, and locating the devices on an isothermal contour. An associated illustration in the Camenzind reference shows a "chip" having three spaced isothermal contours parallel to a long side of a rectangular heat-generating power device. Two transistors are shown positioned side-by-side on the isothermal contour farthest from the power device, and lying parallel with the contour.

U.S. Pat. No. 2,143,390 to Schroter is cited of interest only in that a potentiometer is disclosed which may be built inside a cathode ray tube. Similarly, U.S. Pat. No. 2,859,378 to Gundert et al is cited of interest only in that it discloses a voltage divider used to supply a multiplicity of potentials to the electrodes of an electron gun used in cathode ray tubes. The Gundert et al voltage divider is shown as being installed externally to the cathode ray tube envelope.

OBJECTS OF THE INVENTION

It is a general object of this invention to provide an improved internal voltage divider for a television cathode ray tube capable of supplying selected temperature-invariant intermediate voltages to tube components.

It is a less general object to make it possible to install television cathode ray tubes having components requiring one or more intermediate voltages in television chassis that do not provide such voltages.

It is a more specific object to eliminate the need to introduce relatively high arc-prone voltages through the base of the cathode ray tube.

It is another specific object to provide a method for positioning and arranging the discrete sections comprising the voltage divider.

BRIEF DESCRIPTION OF THE DRAWINGS

The features of the invention which are believed to be novel are set forth with particularity in the appended claims. The invention, together with further objects and advantages thereof, may be best understood, however, by reference to the following description taken in conjunction with the accompanying drawings in which:

DESCRIPTION OF THE PREFERRED EMBODIMENT

In order that the principles of the invention of an internal voltage divider providing one or more temperature-invariant intermediate voltages may be well understood, its application will be described in conjunction with the unitized, in-line electron gun that requires for operation an intermediate potential of, for example, 12 kilovolts. The unitizing of gun construction offers many advantages over non-unitized types, including the fact that if the gun has fewer parts, and the unitizing of the control and accelerating grids reduces the number of connections and circuits. It is to be understood that the use of the present invention is not limited to unitized, inline guns, but is equally applicable to guns of several types and constructions including the non-unitized type. Additionally, the temperature-invariant voltages supplied by the voltage divider according to the invention can be used to supply temperature-invariant voltages to electrodes within the cathode ray tube envelope other than electron gun electrodes; for example, a focus mask electrode.

Figure 2:
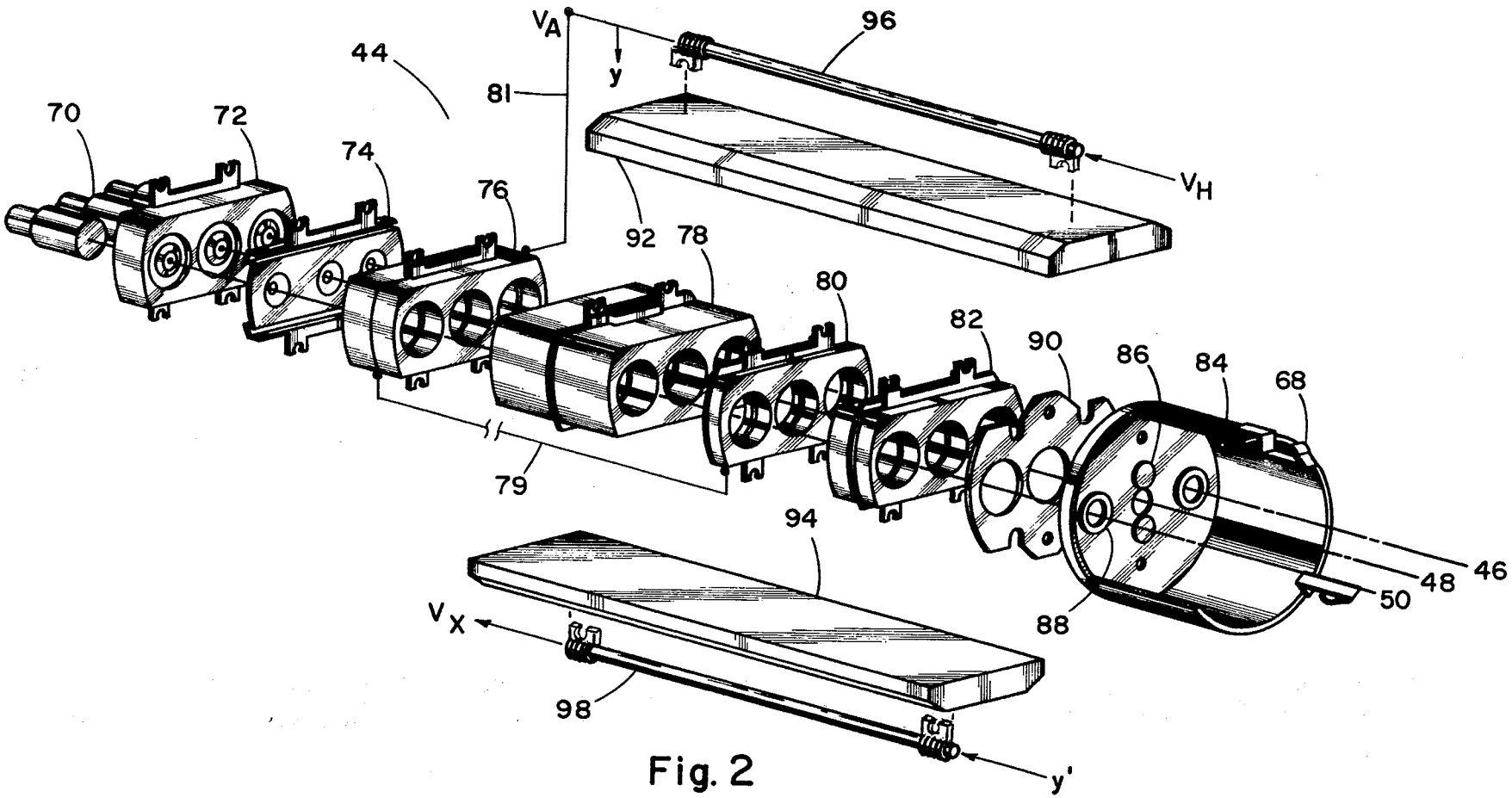
FIG. 2 is an exploded view in perspective of a unitized, in-line electron gun including resistive sections comprising a voltage divider means in accordance with this invention.
Figure 3:
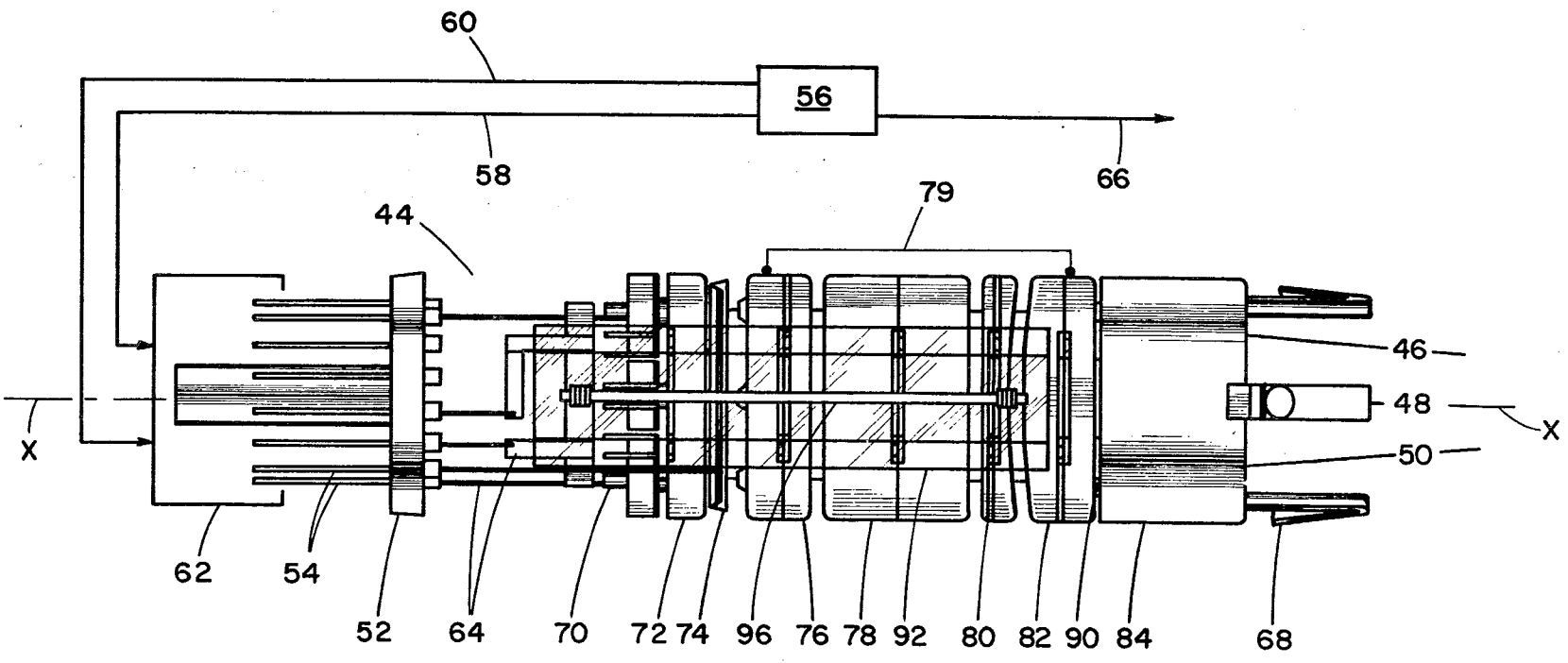
FIG. 3 is an assembled top view of the gun shown in FIG. 2.

FIG. 2 is an exploded view in perspective and FIG. 3 is an assembled view of a unitized, in-line type of electron gun 44 incorporating the present invention. Electron gun 44 generates three-co-planar electron beams 46, 48 and 50, each of which is formed, shaped and directed to selectively energize cathodoluminescent phosphor target elements (not shown).

A cathode ray tube base 52 provides a plurality of lead-in pins 54 for introducing into the envelope of the cathode ray tube television video signals, as well as certain voltages for filament energizing, and for electron beam forming and focusing. A power supply 56, illustrated schematically, develops a predetermined range of voltages for application to the components of electron gun 44, as will be described. Power from power supply 56 is routed directly to electron gun 44 through a plurality of external electrical leads indicated by 58 and 60 to provide the relatively low voltages and intermediate voltage to gun 44 through socket 62 (shown highly schematically) and base 52. Distribution of the voltages to the several electrodes of gun 44 is by means of a plurality of internal electrical leads; typical leads are shown by 64. Power supply 56 also supplies a relatively high voltage; e.g., about thirty kilovolts through lead 66 to a cathode ray tube anode button in electrical contact with a thin coating of electrically conductive material deposited on the inner surface of the cathode ray tube funnel (not shown). The relatively high voltage is in turn routed to the electron gun by metallic gun centering springs 68.

Gun 44 has a tetrode section which generates three separate beam crossovers (not shown) one for each of the three co-planar beams 46, 48 and 50. The four elements comprising the tetrode section are cathodes 70; unitized; three-apertured first grid 72; a unitized; three-apertured disc-type second grid 74; and, the first section of a common electrode 76; that is, the "lower end," or the end nearest the cathode. The tetrode section does not constitute, per se an aspect of this invention, but is described and claimed in referent copending application Ser. No. 694,614, now abandoned.

The beam crossovers are imaged on the screen of the cathode ray tube by respective main focus lens means. The main focus lens means for the three beams 46, 48 and 50 are unitized and constituted first by the "upper end" section of the aforesaid common electrode 76 and, in sequence, main focus electrodes 78, 80 and 82.

The main focus lens means comprises a low-aberrations, low-magnification lens for receiving electrons from cathodes 70, and a predetermined pattern of voltages from power supply 56, to form at a distance an electron beam spot which is small even at high beam currents. The principles of operation of electron gun 44 are fully described and claimed in U.S. Pat. No. 3,995,194 assigned to the assignee of this invention.

Typical potentials of the unitized, in-line gun shown by FIGS. 2 and 3, and used for exemplary purposes in the description of the subject invention may, for example, be as follows: Unitized first grid electrode 72 may be at ground potential, while the potential of unitized second grid electrode 74 may be one kilovolt. The approximate potentials on the electrodes 76, 78 (the main focus electrode) and 80 may be respectively (in kilovolts), 12, 5.8, and 12. The potential of final focus electrode 82 is the same as the potential of the aforedescribed inner conductive coating; that is, about thirty kilovolts.

Convergence of outer beams 46 and 50 inwardly to a common point of landing with central beam 48 is accomplished by a slight angling of the two opposing planoparallel faces between electrodes 80 and 82. The angles extend outwardly and forwardly relative to the gun's central axis X—X. This convergence electrode concept per se does not constitute a part of this invention, but is described and claimed in referent U.S. Pat. No. 4,058,753.

The electrodes of electron gun 44 are further characterized by having three effectively continuous, electrically shielding beam-passing tubes extending completely through the electrodes, each tube being formed by a contiguous axial succession of deep-drawn annular lips. The beam-passing tube concept does not constitute, per se, an aspect of this invention, but is described and claimed in the referent copending application Ser. No. 655,592, now abandoned.

The last in the series of components that comprise gun 44 is a support cup 84 that provides a mounting base for the three springs 68 which center the forward end of gun 44 in the neck of the cathode ray tube. Also, through contact with an electrically conductive coating on the inside of the neck of the tube as heretofore described, contact springs 68 conduct the aforedescribed high voltage through support cup 52 to electrode 82. Located within the cavity formed by support cup 84, and adjacent to the apertures from which the three electron beams 46, 48 and 50 emerge, are enhancer magnets 86 and shunt magnets 88. Support cup 84 is aligned and bonded to electrode 82 in precise registration by means of a carrier plate 90, which lies between the two elements. The carrier plate support cup mounting concept does not constitute, per se, an aspect of this invention, but is described and claimed in copending application Ser. No. 649,630, now abandoned. Neither does the associated assembly method constitute, per se, as aspect of this invention, but is described and claimed in copending application Ser. No. 736,792 now U.S. Pat. No. 4,063,340.

In the unitized, in-line gun described in this disclosure, unitized grids and electrodes 72, 74, 76, 78, 80 and 82 have on each side thereof at least one pair of widely spaced, relatively narrow claws embedded at widely spaced points on wide beads 92 and 94. This structural concept does not constitute, per se, an aspect of this invention, but is fully described and claimed in U.S. Pat. No. 4,032,811 assigned to the assignee of this invention. Contiguous to beads 92 and 94 and shown as being exploded therefrom in FIG. 2, are first and second resistive sections 96 and 98 comprising a voltage divider disclosed as an embodiment of the present invention, as will be shown.

The present invention comprises an improved voltage divider means for producing one or more temperature-invariant voltages for operation of components within the envelope of the television cathode ray tube.

One embodiment of the voltage divider means according to this invention is comprised of the aforesaid discrete resistive sections 96 and 98, shown in FIG. 2. First resistive section 96, locatedd contiguous to bead 92, and second resistive section 98, located contiguous to bead 94, are series-connected by connecting means not shown in FIG. 2. (The series connection could be made for example, by electically interconnecting y and y'.) According to the invention, resistive section 96 receives a relatively high anode voltage from the inner conductive coating deposited on the internal surface of the funnel of the evacuated cathode ray tube envelope; the relatively high anode voltage connection is indicated by $V_H$. The opposite, or "low," end of the voltage divider comprising series-connected resistive sections 96 and 98 is connected to a suitable low-voltage terminal for receiving a relatively low voltage through the base of the tube (not shown); the relatively low voltage connection is indicated by $V_X$.

Electrodes 76 and 80 of the electron gun shown by FIG. 2 require a temperature-invariant voltage intermediate to the relatively high voltage supplied by the aforesaid inner conductive coating through connection $V_H$, and the relatively low voltage supplied to connection $V_X$ from the aforesaid low-voltage terminal. This intermediate voltage is shown as being tapped off at a point $V_A$ between first and second resistive sections 96 and 98 to supply the required intermediate voltage to electrode 76 through some form of common connective means such as a conductive wire, indiated by 81. The potential supplied to electrode 76 may be of the order of twelve kilovolts in accord with the voltage requirements of the electron gun represented by FIGS. 2 and 3, and described and claimed in the aforementioned U.S. Pat. No. 3,995,194. Electrodes 76 and 80 are electrically connected according to the '194 patent; the connection is indicated by lead According to the invention, first and second resistive sections 96 and 98 have like temperature coefficients, and have resistive values of the same order of magnitude. Resistive sections 96 and 98 are so positioned and arranged relative to internal spatial temperature patterns, fixed or varying with time, which are incidental to tube warm-up and operation as to have similar spatial average temperature experiences. Due to the similarity of these temperature experiences, the ratio of resistance values of the resistive sections, and thus the ratio of voltage drops thereacross does not change despite variations in said temperature patterns.

In general terms, the voltage divider according to this invention provides "N" different temperature-invariant voltages intermediate to the relatively high anode voltage, and, the relatively low voltage introduced through the base of the tube, to one or more electrodes in the tube. The voltage divider comprises N + 1 number of discrete sections having like temperature coefficients, and having resistive values of the same order of magnitude, with N number of taps to provide N temperature-invariant voltages.

In addition to making possible a voltage divider that is capable of providing one or more temperature-invariant voltages, there are other salient benefits in utilizing two or more resistive sections to form the voltage divider according to this invention. The first of these concerns the lack of available space within the neck of the cathode ray tube; by utilizing at least two resistive sections, the considerable heat that will be generated by the voltage divider will be dissipated over a wider area than would be the case if a single-section voltage divider were used. The ability to dissipate the heat it generates is a particularly important capability of the voltage divider according to this invention. The voltage divider should preferably be designed to draw a current of about sixty microamperes; this magnitude of current is necessary to compensate for any irregularity in flow due to leakage in the electron gun, for example. (Without an adequate flow of electrons through the voltage divider, the output would fluctuate widely under varying load.) In consequence, considerable heat will be generated by voltage divider operation; e.g., several hundred degrees centigrade.

Another advantage of having a voltage divider made up of at least two sections is that it is easier to conform a two-(or more) section resistor to the configurations of the cathode ray tube and electron gun components to which the voltage divider can be attached. Also, by using multiple sections, a longer resistive path can be formed, and it is axiomatic that the longer the resistive path, the lower the voltage drop per unit length will be, and the more stable the voltage divider output will be.

Figure 4:
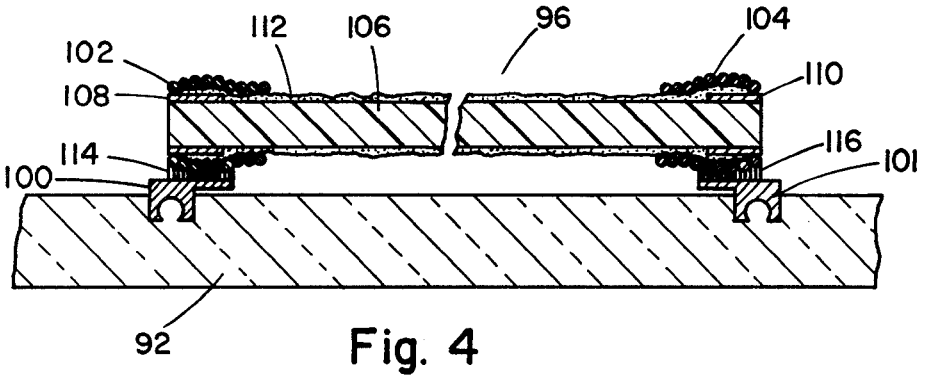
FIG. 4 is an enlarged side view in section of a resistive section according to the invention shown in FIGS. 2 and 3.

The structure of resistive sections 96 and 98 comprising a voltage divider according to this invention, is shown enlarged in FIG. 4. Resistive section 96 is used as an example, and is here shown in cross-section as being attached to structural bead 92 by means of "claws" partially embedded in the bead, also shown in cross-section. Attachment of the resistive section to the bead by means other than the claws shown is entirely feasible; for example, attachment could as well be made by simple wrap-around wire loops or bands. The structure of resistive section 96 is preferably supported by brackets 100 and 101 which may be bonded as by welding to coil spring connectors 102 and 104. Connectors 102 and 104 make a very sound mechanical and electrical engagement to resistive section 96. The coil spring connectors per se do not constitute an aspect of the present invention, but are described and claimed in the referent application Ser. No. 830,270.

The cylindrical aspect of resistive section 96 has its basis in a rod 106 of non-conductive material, such as a ceramic. On the opposed ends of rod 106 are deposited conductive termination coatings 108 and 110 which may comprise nickle, silver, irridium, or gold, for example. Coatings 108 and 110 ensure sound electrical contact with the resistive coating 112, which comprises the resistive entity of resistive section 96. The composition of resistive coating 112 may comprise, for example, a common commercially available thick-film screenable paste made up of primarily of Ruthenium oxide in a glass carrier. This paste may be applied by brushing, spraying, or dipping. Upon application of heat, the glass carrier melts and bonds permanently to the substrate. The thickness of film 112 determines the resistive value of resistive section 96, so that manufacture of the resistive section can be a simple matter of applying the proper thickness of coating. The factor of resistivity as a function of film thickness has another advantage in that the length of resistive section 96 can be varied to fit available support structures, such as the glass beads of various lengths commonly used to support and position the electrodes of cathode ray tube electron guns.

It will be noted that the resistive coating 112 overlaps the metal termination coatings 108 and 110 in order to assure the integrity of the electrical connection therebetween. Coil spring connectors 102 and 104 may be formed of Inconel, a metal which has a spring characteristic, and is compatible with a clean high-vacuum environment within a cathode ray tube. Inconel also lends itself to the welding of coil spring connectors 102 and 104 to brackets 100 and 101, respectively; the weldments are indicated by 114 and 116.

The particular structure of resistive section 96 and its terminations as shown do not constitute as aspect of the present invention, per se, but rather are described and claimed in the referent application Ser. No. 811,494. The resistive section could as well comprise a bulk mode resistor or a cermet.

It is feasible that resistive sections 96 and 98 shown by FIG. 2 could be attached to structural beads 92 and 94 at the time of the assembly of the electron gun. The standard production assembly procedure is to hold the electrodes and other sub-assemblies of the gun in proper relationship to each other by means of mechanical fixtures, then fasten all parts together by pressing a heat-softened bead of glass onto the "claws" which form in integral part of each gun component, including resistive sections 96 and 98 (electrode claws are shown by FIG. 2). Upon cooling of the bead and removal of the fixtures, the claws are permanently embedded in the glass beads, and the components of the gun are permanently affixed in proper spatial relationship to each other. Resistive section 96, after attachment by welding to the clawed brackets 100 and 101, could as well be installed in the heat-softened structural bead 92 during the gun assembly process heretofore described.

Figure 4A:
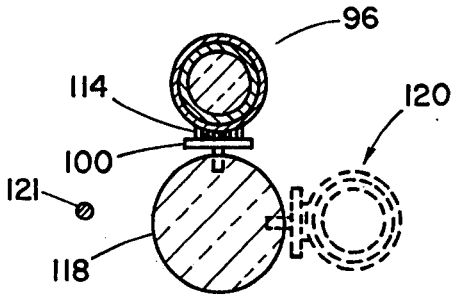
FIG. 4A shows the FIG. 4 resistive section in end view and its attachment in relation to a cylindrical structural bead.

Resistive sections 96 and 98 are shown in FIG. 2 as being installed in relatively wide beads 92 and 94, respectively. The mounting of the resistive means is not restricted to the bead configuration shown. For example, as shown by FIG. 4A, resistive sections 96 or 98 could as well be installed in conjunction with a structural bead of the widely used circular configuration, as typified by bead 118. Attachment could be made by means of pressing the claws of bracket 100 into heat-softened glass of bead 118, or, attachment may be made by means of a simple wrap-around loop or band of metal (not shown). Also, it is not necessary that resistive section 96 be installed at the "top" of the bead as shown; resistive section 96 could as well be positioned at any convenient orientation with respect to bead 118, such as the orientation shown by location 120. In location 120, resistive section 96 would be more remote from a hypothetical electrical lead having a widely different potential thereon, such as indicated by lead 121.

Figure 4C:
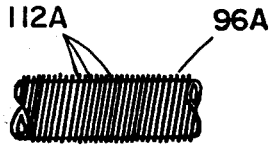
FIG. 4C is a side view of a fragment of the FIG. 4 resistive section wherein the resistive path is in the form of a helix.
Figure 4B:
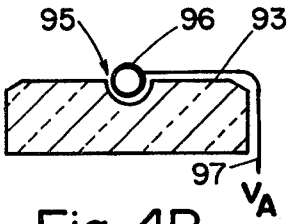
FIG. 4B is an end view in cross section showing the FIG. 4 resistive section installed in a recess in a wide bead.

The form factor of the aforedescribed "wide bead" is advantageous to another means of mounting the resistive sections in relation to the bead; this mounting means is shown by figure 4B. Bead 93 is provided with a recess 95 which conforms to the cylindrical configuration of resistive section 95, which is inset into recess 95 as shown. The major advantage of such recessing of the resistive section lies in the enhanced isolation of the resistive means from, for example, the close-lying neck of the cathode ray tube. Bead 93, when comprised of glass, effectively insulates resistive section 96 from underlying gun electrodes having disparate potentials. Conductor 97 can be routed as shown to provide a tapped intermediate potential $V_A$ to an underlying gun electrode.

Further with regard to the resistive coating 112 deposited on cylinder 106, shown by FIG. 4: For maximum stability of the voltage divider according to the invention, it is desirable that the resistive path be as long as is practical. FIG. 4C shows a well-known means for prolonging the resistive path of the resistive configuration of FIG. 4, wherein resistive coating 112A is deposited in the form of a helix on the surface of the cylindrical resistive means 96A. The coating may be heliformed by well-known means such as masking and spraying, or, by first depositing the coating then forming it into a helix by lathe means, using a diamond-tipped cutter.

The discrete resistive section comprising the temperature invariant voltage divider are, according to the invention, positioned and arranged so as to have similar average spatial temperature experiences. So it is essential that the discrete resistive means comprising the voltage divider be optimally located in the cathode ray tube envelope to provide similarity of the spatial average temperature experiences of the resistive sections.

Figure 5A:
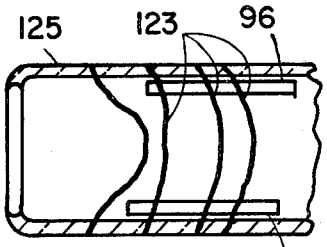
FIG. 5A is a side view in section of a fragment of a cathode ray tube neck indicating the proper positioning and arranging of two resistive sections in relation to internal spatial temperature patterns, according to the invention.
Figure 1:
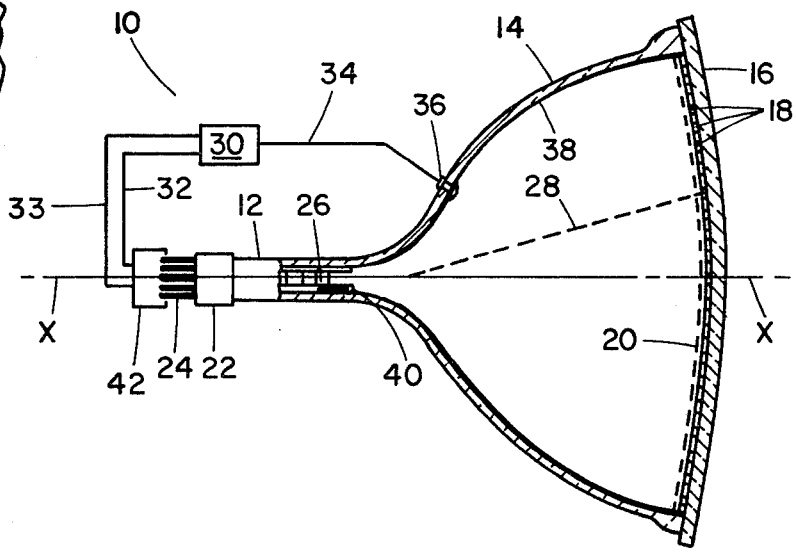
Fig. 1 PRIOR ART
FIG. 1 is a schematic side sectional view of a prior art color cathode ray tube and its interconnections with the power supply.
Figure 5:
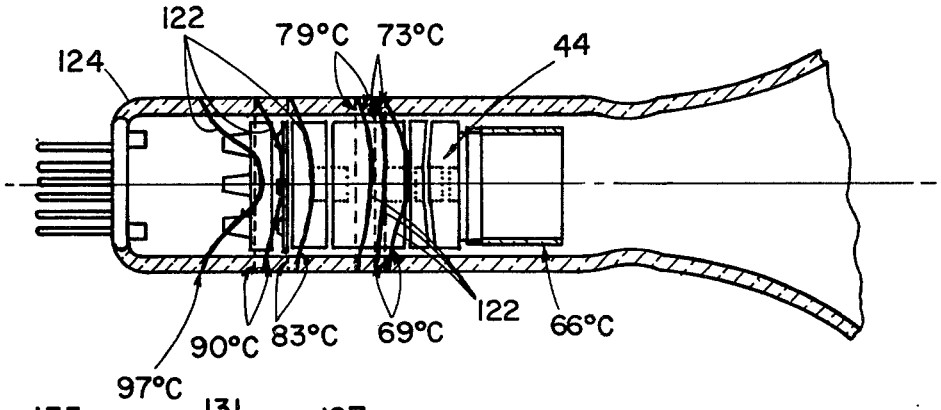
FIG. 5 (sheet 1) is a side view in section of a fragment of a cathode ray tube envelope showing the distribution of isothermal lines indicating internal spatial temperature patterns in the neck region.

FIG. 5 indicates by means of isothermal lines 122 typical internal spatial temperature patterns in a cathode ray tube neck 124, and about the electron gun 44 contained therein. The positioning and arrangement of the discrete resistive sections comprising a voltage divider is a determination dependent upon the distribution of heat within the cathode ray tube neck 124, indicated by the isothermal lines 122.

Figure 5B:
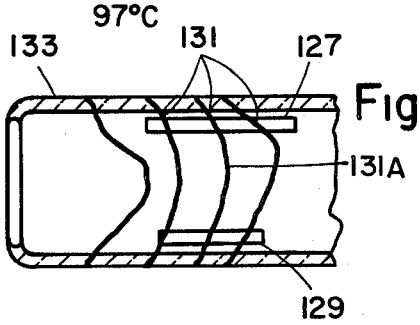
FIG. 5B is a view similar to FIG. 5A showing the positioning and arrangement of two resistive sections having different lengths.

FIG. 5A illustrates how two resistive sections of the same length, sections 96 and 98, shown schematically, may be positioned in relation to a hypothetical distribution of heat indicated by isothermal lines 123. As shown by FIG. 5B, the resistive sections, resistive sections 127 and 129, need not be of the same length as long as they have similar average temperature experiences. The method according to the invention, for positioning and arranging the resistive sections comprises determining the internal spatial temperature patterns and associated isothermal lines. The discrete sections are then positioned and arranged so that each lies transverse to and resistance-centered on a common isothermal line, whereby due to the similarity of spatial average temperature experiences of the resistive sections, the ratio of resistive values of the resistive sections, and thus the ratio of voltage drops thereacross does not change despite variations in the aforementioned temperature patterns.

Referring again to FIG. 2, supporting beads 92 and 94 are shown as supporting resistive sections 96 and 98, which are in the form of cylindrical rods as heretofore described. The form factor of structural beads 92 and 94, however, is also particularly suitable for the effective mounting of resistive sections of other form, such as, for example, resistive sections comprising a resistive deposit in the form of a thick film, as will be shown. It will be seen that each of the electrodes of electron gun 44 (72, 74, 76, etc.) have on each side thereof one pair of widely spaced, relatively narrow integral claws which lie respectively in planes transverse to the axis X—X of gun 44. The claws in each pair are embedded at widely spaced points respectively in beads 92 and 94 so as to enhance the lateral stability of the electrodes, and enhance the establishment and maintenance of parallelism, precise spacing, and aperture concentricity of adjacent ones of the electrodes. Further as a result of this configuration, each bead 92 and 94 has a central, axially extending section between the claws of each claw pair which is free from embedment of claws. This central, axially extending section free from embedment of claws provides a central uniform and mechanically strong section well-adapted to support the embodiments of a voltage divider according to this invention. (As noted heretofore, this improved support structure is described and claimed in U.S. Pat. No. 4,032,811.)

Figure 6A:
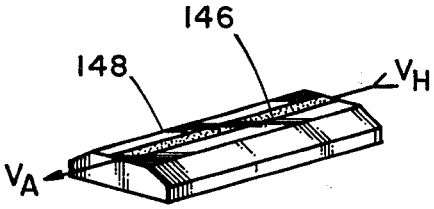
FIG. 6A shows an alternative application of a resistive section comprised of a stripe of resistive material.
Figure 6:
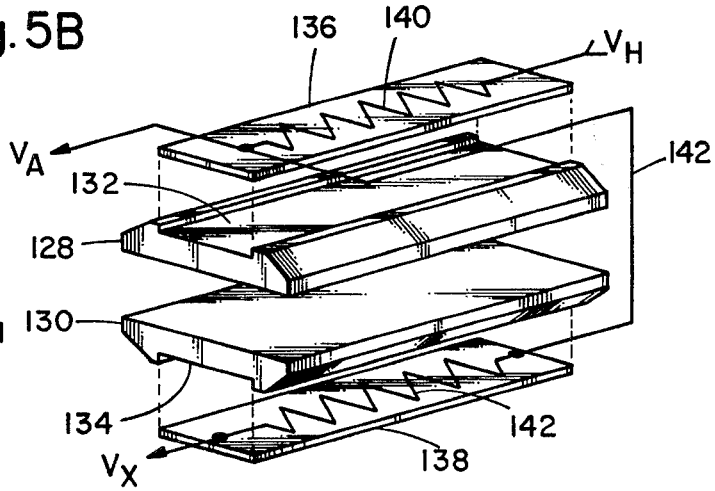
FIG. 6 (sheet 1) is an isometric view of two resistive sections according to this invention installed in recesses in structural beads.

FIG. 6 shows in greater detail the general form of the axially oriented structural beads shown by FIGS. 2 and 3. In this embodiment of the invention, beads 128 and 130 are shown as having rectangular recesses 132 and 134 (in contrast to a rounded recess, shown in FIG. 4B) for receiving, respectively, resistive sections 136 and 138 shown as being exploded from the respective structural beads. Recesses 132 and 134 for receiving the respective resistive sections 136 and 138 are made possible by the structure of beads 128 and 130, as each bead has a central, axially extending section which is free from embedment of the claws of the electrodes. The resistive nature of resistive sections 136 and 138 is indicated by resistor symbols 140 and 142 comprising a voltage divider according to this invention. Resistive section 136 receives a relatively high anode voltage from a source indicated by $V_H$. Resistive section 136 is series-connected to the second resistive section 138 by suitable connecting means indicated by 142. $V_X$ is connected to a suitable low-voltage terminal for receiving a relatively low voltage through the base of the tube. An intermediate voltage is shown as being tapped off at point $V_A$ between resistive sections at 136 and 138.

Another embodiment of the invention is shown by FIG. 6A wherein the resistive sections comprise a thick-film resistive stripe 146 deposited on the surface of structural bead 148, shown as being unrecessed. Resistive stripe 146 may be composed of the same resistive material described for application to the cylindrical resistive means 96 heretofore described; that is, a thick-film paste wherein the resistive entity comprises, primarily, Ruthenium oxide. This paste may be applied by laying a suitable mask on the surface of bead 148 shown by FIG. 6A, and spraying or otherwise depositing a desired thickness of resistive material to provide the desired resistive value. The path length of the stripe can be extended as desired by appropriately zig-zagging the deposit.

Only one resistive stripe 146 is shown by FIG. 6A. This embodiment of the invention is not limited to one stripe; for example two, or even three or more such stripes may be deposited in parallel on suitable surfaces of structural bead 148 and series-connected. The propinquity of the resistive stripes so deposited helps ensure the similarity of spatial average temperature experiences of each of the resistive sections, according to the invention.

Figure 7:
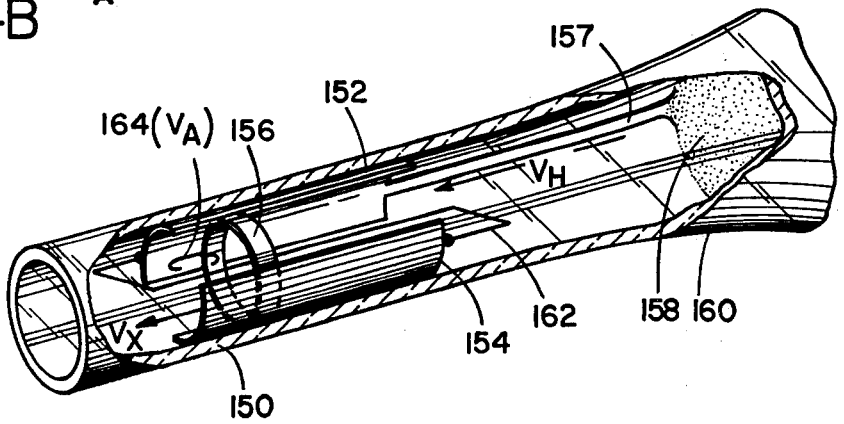
FIG. 7 is a cutaway view in perspective of a cathode ray tube neck showing another embodiment of the voltage divider according to this invention.

Another embodiment of the voltage divider means according to this invention is shown by FIG. 7 wherein a pattern of resistive coatings is deposited on the inner surface of the neck 150 of a television cathode ray tube. First resistive section 152 and second resistive section 154 are shown in conjunction with an electron gun electrode 156 (shown schematically) that requires an intermediate temperature-invariant voltage according to this invention. The relatively high anode voltage may be supplied to first resistive section 152 by a conductive strip 157 which may be plated on the inner surface of neck 150 to make electrical contact with electrically conductive coating 158 deposited on the internal surface of the funnel 160 of the cathode ray tube. As noted, the relatively high anode voltage is received through an anode button (not shown) in funnel 160. First resistive section 152 and second resistive section 154 are shown as being series-connected by means of conductor 162.

This conductor may comprise a wire as shown, or it may comprise a conductive strip plated onto the inner surface of neck 150. As before, connection $V_X$ may be routed to a suitable low-voltage terminal for receiving a relatively low voltage through a base of the tube to complete the circuit. Means for tapping off an intermediate voltage $V_A$ required by gun electrode 157 at a point between first resistive section 152 and second resistive section 154 may be by means of a resilient spring conductor 164. One end of spring conductor 164 may be attached to electrode 156 while the other end may make electrical contact with a resistive coating deposited on the neck of tube 150 shown as comprising first resistive section 152. Spring 164 may be similar in construction and material to the aforementioned gun centering springs 68.

First and second resistive sections 152 and 154 deposited on the inner surface of neck 150 are positioned and arranged within the neck so as to have similar average temperature experiences, according to this invention. The criteria for positioning and arranging first and second resistive sections 152 and 154 are identical to the requirements for positioning the resistive sections of a voltage divider capable of supplying a temperature-invariant voltage, installed in conjunction with an electron gun, as described heretofore. The positioning and arrangement would be similarly accomplished by determining the internal spatial temperature patterns and associated isothermal lines, then positioning and arranging the discrete sections so that each lies transverse to and resistance-centered on a common isothermal line.

Figure 8:
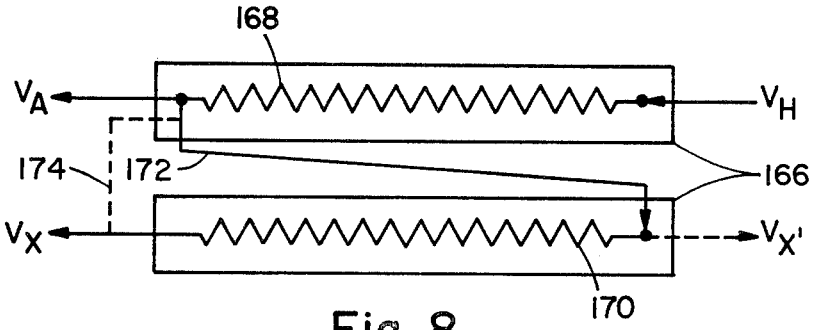
FIGS. 8, 9 and 10 show schematically various interconnections and outputs of the voltage divider according to this invention.
Figure 9:
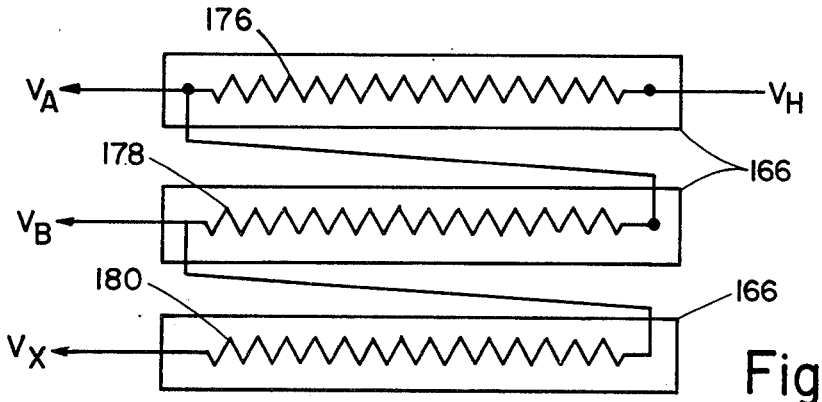
Figure 10:
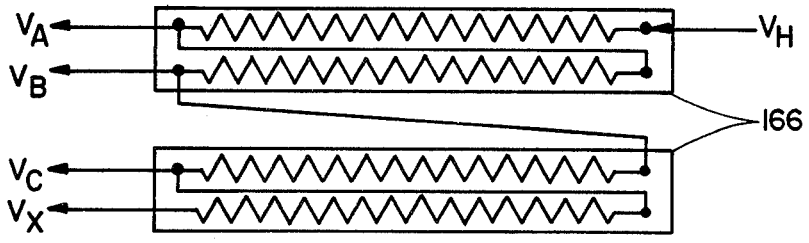

FIGS. 8, 9 and 10 show schematically three embodiments of a voltage divider according to this invention that provide temperature-invariant voltages for television cathode ray tube components. The mounting structure 166 for each embodiment is shown symbolically as comprising a substrate in rectangular form; mounting structure 166 could as well comprise any of a number of configurations convenient for the mounting of the resistive sections (shown in familiar symbolic form) comprising the voltage divider. For example, mounting structure 166 could comprise the aforementioned cylindrical rod, a structural bead, the inner surface of the cathode ray tube neck, or other suitable repository within the cathode ray tube envelope.

FIG. 8 shows schematically the connection of the resistive sections comprising a voltage divider according to the invention described heretofore and shown in FIGS. 2, 6 and 7 wherein the voltage divider provides one temperature-invariant intermediate voltage. First resistive section 168 and second resistive section 170 of the voltage divider shown by FIG. 8 have like temperature coefficients and have resistive values of the same order of magnitude, and are properly located with respect to the internal spatial temperature patterns as heretofore described. The relatively high anode voltage connection is indicated by $V_H$ and the relatively low voltage connection at the opposite, or "low" end is indicated by $V_X$. The intermediate voltage is tapped off at a point $V_A$, also noted heretofore.

The interconnection of first resistive section 168 and second resistive section 170 is shown as being made between the intermediate voltage tap-off point $V_A$ of first resistive section 168, and the opposite end of second resistive section 170, by means of conductor 172. This means of interconnection is not mandatory according to this invention; alternatively, the direction of the current in resistive section 170 could as well be reversed by eliminating conductor 172 and making the connection by means of conductor 174, indicated by a broken line. By this means of interconnection, the relatively low-voltage connection would be at $V_X'$, if a more convenient connection point lay in that direction. This and all other connecting means shown are made possible according to this invention when the resistive means are of like temperature coefficients, have resistive values of the same order of magnitude, and are properly located in relation to the internal spatial temperature patterns, as described.

FIG. 9 shows, again schematically, another embodiment of the invention which comprises a voltage divider that provides two intermediate temperature-invariant voltages. The voltage divider means shown by FIG. 9 comprises first resistive section 176, second resistive section 178 and third resistive section 180. As before, the relatively high voltage and relatively low voltage connections are made at $V_H$ and $V_X$, respectively. The temperature-invariant voltages intermediate to the relatively high and relatively low voltages are shown as being tapped off at points $V_A$ and $V_B$.

Another embodiment of the invention is shown by FIG. 10, wherein a plurality—in this case three—voltages are tapped off the voltage divider, with the tap-off points indicated by $V_A$, $V_B$ and $V_C$.

Figure 11:
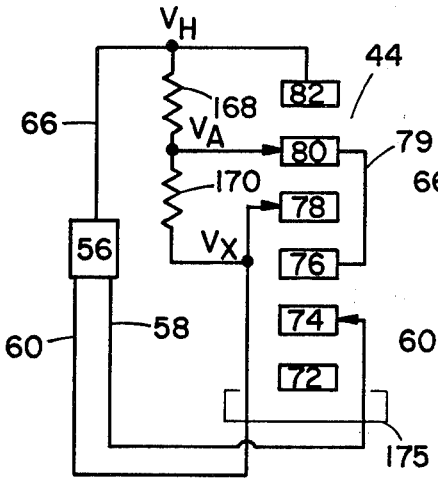
FIGS. 11, 12 and 13 are schematic diagrams of power supply-voltage divider circuits according to this invention variously connected to supply potentials to the electrodes of the electron gun having an extended field main focus lens as described and claimed in U.S. Pat. No. 3,995,194.
Figure 12:
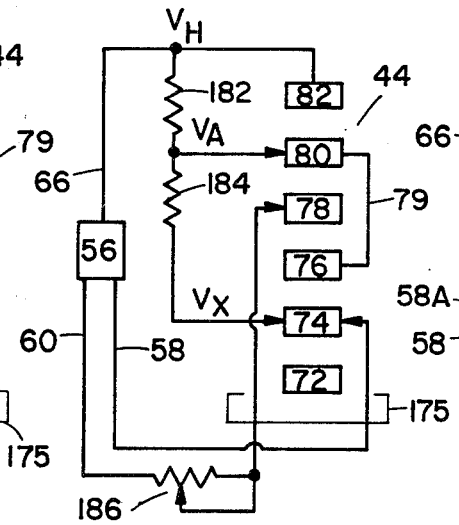
Figure 13:
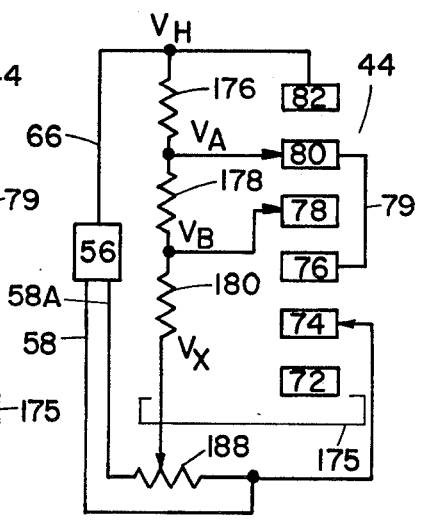

FIGS. 11, 12 and 13 show in highly schematic form three voltage divider circuits that provide temperature-invariant voltages to the main focus electrodes of the unitized, in-line electron gun having an extended field lens, a described in the foregoing, and shown by the FIGS. 2 and 3. The electrodes of gun 44 are shown schematically, and are numbered referentially as 72, 74, 76, 78, 80 and 82, as in FIGS. 2 and 3. Similarly reference-numbered as in FIGS. 2 and 3 are power supply 56 and the leads 58, 60 and 66 also as heretofore described. Power supply 56 supplies a relatively high voltage of about 30 kilovolts to electrode 82 of gun 44. The voltage divider according to the invention that provides temperature-invariant voltages for the electrodes of gun 44 is shown schematically as being comprised of at least two resistive sections. It will be observed that electrode 76 carries the same potential as electrode 80 as the two are electrically interconnected by conductor 79.

FIG. 11 shows schematically the use of a voltage divider according to this invention for applying an intermediate temperature-invariant voltage to the aforedescribed electron gun 44, which has an extended field main focus lens. A relatively low voltage, nominally one kilovolt, is shown as being applied to accelerating electrode 74 through lead 58 from power supply 56, entering through base-socket combination 175. Power supply 56 also supplies another relatively low voltage of 5.8 kilovolts through lead 60, entering the tube envelope through base-socket combination 175. This potential of 5.8 kilovolts is routed to main focusing electrode 78, as shown, and is also connected to the "low" end of the voltage divider, as shown by connection $V_X$. The intermediate voltage tapped off at $V_A$ provides a relatively intermediate voltage of about 12 kilovolts required by interconnected electrodes 80 and 76. If the potential at point $V_H$ of the voltage divider is 30 kilovolts, and the potential at point $V_X$ is 5.8 kilovolts, the intermediate voltage at point $V_A$ would be about 12 kilovolts, according to the formula $V_A = V_H - V_X$, where first resistive section 168 and second resistive section 170 are equal in resistive value. Based upon an anticipated current of 60 microamperes in the voltage divider circuit, the resistive value of resistive sections 168 and 170 would each be about 200 megohms, according to Ohm's law.

The benefit of the voltage divider means according to this invention is shown by FIG. 11 in that only the relatively low voltage of 5.8 kilovolts need be introduced into the cathode ray tube through base-socket combination 175; otherwise, the relatively high 12 kilovolt intermediate potential would also have to be introduced through base-socket combination 175. As noted heretofore, the introduction of potentials of the magnitude of twelve kilovolts through the base-socket combination 175 has presented serious problems which are ameliorated by the introduction of the voltage divider according to this invention into the cathode ray tube envelope.

It is often desirable in extended field electron guns of the tupe described to control precisely the potential on the main focusing electrode which, in this electron gun configuration, is electrode 78. The circuit shown by FIG. 12 is modified to route the potential of 5.8 kilovolts supplied by power supply 56 through lead 60 directly through the base-socket combination 175 to electrode 78, as shown. Control of the potential on electrode 78 is accomplished by means of a potentiometer 186. In this circuit configuration, the "low" end of the voltage divider comprised of first resistive section 182 and second resistive section 184 is attached to electrode 74, which is supplied with a potential of one kilovolt, for example, through lead 58 from power supply 56 entering the cathode ray tube envelope through base-socket combination 175.

As noted, electrically linked electrodes 76 and 80 require a potential of about 12 kilovolts for operation. The voltage across the voltage divider comprising first resistive section 182 and second resistive section 184 equals 29 kilovolts; that is, $V_H$(30 kilovolts) minus $V_X$(1 kilovolt), equals 29 kilovolts. To provide the desired potential of 12 kilovolts at tap point $V_A$, requires a voltage drop of 18 kilovolts across first resistive section 182, and 11 kilovolts across second resistive section 184. Assuming a current of 60 microamperes through the voltage divider, the resistive value of first resistive section 182 according to Ohm's law is $3 \times 10^8$ ohms. The resistive value of second resistive section 184 would be, according to the same formula, $1.8 \times 10^8$ ohms. Although the resistive values of first resistive means 182 and second resistive means 184 are different, they have like temperature coefficients and have resistive values of the same order of magnitude according to the invention and therefore meet the criteria of the invention in that the ratio of resistive values and thus the ratio of the voltage drop across the two resistive sections does not change. Since only a very small range of voltage adjustment is required for main focus electrode 78, the resistive value of potentiometer 186 would be in the $10^9$ ohm range, (as its resistive value is relatively small, the resistance of potentiometer 186 has not been taken into consideration in the foregoing calculations).

Another circuit, shown by FIG. 13, represents an embodiment of this invention that also provides temperature-invariancy of the intermediate potential supplied to the electrodes of gun 44. Power supply 56 supplies 30 kilovolts to $V_H$ of the voltage divider means shown. Conductor 58 from power supply 56 supplies a voltage of about one kilovolt directly to electrode 74 through base-socket combination 175; one kilovolt is also supplied to one leg of potentiometer 188, as shown. Conductor 58A supplies, for example, a nominal two kilovolts to the other leg of potentiometer 188. $V_X$ of the voltage divider means is routed through base-socket combination 175 to the movable tap of potentiometer 186 as shown, providing for adjustment of potential on main focusing electrode 78 through voltage divider tap $V_B$. A major advantage of this circuit configuration lies in the fact that two very low voltages are routed through the base-socket combination 175, that is, one kilovolt and two kilovolts, providing a resolution of the major problem inherent in introducing a plurality of relatively higher voltages through the base of the tube.

To provide a voltage of 12 kilovolts at tap point $V_A$, and 5.6 kilovolts at tap point $V_B$, there must be a voltage drop of 18 kilovolts between points $V_A$ and $V_B$; that is, across first resistive section 176. The voltage drop across second resistive section 178 would be 6.2 kilovolts to supply 5.8 kilovolts to main focus electrode 78. The voltage drop across third resistive section 180 is 3.8 kilovolts. Assuming a current of 60 microamperes through the voltage divider, the resistive value of first resistive section 176 is about 300 megohms, the resistive value of second resistive section 178 is about 100 megohms and the resistive value of third resistive section 180 is about 60 megohms. The value of potentiometer 188 would be similar to that of potentiometer 186 shown in FIG. 12; that is, about $10^9$ ohms.

The voltage divider circuit configurations shown by FIGS. 8–13, and the resistive values as described, are provided for exemplary purposes only, and imply no limitation in the scope of the possible variations in voltage divider configurations according to the invention.

The foregoing embodiments of the invention are shown as supplying one or more intermediate voltages to the electrodes of a cathode ray tube electron gun. The utilization of the temperature-invariant intermediate voltages supplied by the voltage divider are not limited to electron guns; other electrodes within the cathode ray tube envelope may require such intermediate voltages. For example, certain cathode ray tubes having focus masks for post-deflection focusing may require a voltage intermediate to the relatively high anode voltage and a relatively low voltage available through the base of the tube. The voltage divider may be in the form of one of the embodiments described heretofore, that is, mounted in conjunction with the electron gun, or, in the form of deposits on the inner surface of the neck of a cathode ray tube. The connection to the focus mask or other cathode ray tube electrodes requiring an intermediate voltage could be made by a conductive strip deposited on the inner surface of the funnel, or by a discrete conductor suitably positioned.

Among the many benefits accruing from the use of the voltage divider means according to this invention, two merit special mention. The first is that cathode ray picture tubes having electrodes therein that require one or more potentials in the intermediate range as defined herein, such as certain electrodes of extended field lens guns, may, through the use of the voltage divider according to the invention, be installed in the chassis of standard television sets wherein such potentials are not otherwise available. Also, the incorporation of the voltage divider means within the cathode ray tube envelope makes possible the simplification of the circuits of the external power supply, primarily through the elimination of the external voltage divider circuits otherwise required. The base-socket combination could also be greatly simplified as well as only relatively low voltages would be conducted through the combination.

Other changes may be made in the above-described voltage divider without departing from the true spirit and scope of the invention herein involved. It is intended therefore that the subject matter of the foregoing depiction shall be interpreted as illustrative and not in a limiting sense.

We claim:

1. In a television cathode ray tube comprising an evacuated envelope including a faceplate and a funnel having on an internal surface thereof an inner conductive coating for receiving a relatively high anode voltage, said tube also having a low-voltage terminal for receiving a relatively low voltage through a base of the tube, said tube being subject to internal spatial temperature patterns fixed or varying with time which are incidental to tube warm-up and operation, and having "N" electrodes therein requiring "N" different temperature-invariant voltages intermediate to said relatively high and relatively low voltages, an improved voltage divider means for producing said N temperature-invariant voltages, comprising N + 1 discrete resistive sections having like temperature coefficients and having resistance values of the same order of magnitude, with N taps to provide said N temperature-invariant intermediate voltages to said electrodes requiring such voltages, with each of said resistive sections being so positioned and arranged relative to said temperature patterns as to have similar spatial average temperature experiences, and connecting means for series-connecting said resistive sections between said inner conductive coating and said low voltage terminal, whereby due to the similarity of spatial average temperature experiences of said resistive sections, the ratio of the resistance values of said resistive sections and thus the ratio of voltage drops thereacross does not change despite variations in said temperature patterns.

2. In a television cathode ray tube comprising an evacuated envelope including a faceplate and a funnel having on an internal surface thereof an inner conductive coating for receiving a relatively high anode voltage, said tube also having a low-voltage terminal for receiving a relatively low voltage through the base of the tube, said tube being subject to internal spatial temperature patterns fixed or varying with time which are incidental to tube warm-up and operation, and having at least one electrode therein requiring a temperature-invariant voltage intermediate to said relatively high and relatively low voltages, an improved voltage divider means for producing said temperature-invariant voltage comprising discrete first and second resistive sections having like temperature coefficients, and having resistive values of the same order of magnitude, and with one tap to provide said temperature-invariant voltage to said electrode with each of said resistive sections being so positioned and arranged relative to said temperature patterns as to have similar average temperature experiences, and connecting means for series-connecting said first and second resistive sections between said inner conductive coating and said low-voltage terminal, whereby due to the similarity of spatial average temperature experiences of said first and second resistive sections, the ratio of the resistance values of said first and second resistive sections and thus the ratio of the voltage drops thereacross, does not change despite variations in said temperature patterns.

3. An improved electron gun for use in a television cathode ray tube, said tube comprising an evacuated envelope including a neck, a faceplate and a funnel having on an internal surface thereof an inner conductive coating for receiving a relatively high anode voltage, said tube also having a low-voltage terminal for receiving a relatively low voltage through a base of the tube, said tube being subject to internal spatial temperature patterns fixed or varying with time which are incidental to tube warm-up and operation, with said gun being located in said neck with electrodes supported by structural beads, the last electrode of said gun; that is, the electrode nearest the faceplate, receiving said relatively high voltage through contact means with said inner conductive coating, said gun having at least one other electrode requiring a temperature-invariant voltage intermediate to said relatively high and relatively low voltages, the improvement comprising a gun having voltage divider means for producing "N" intermediate temperature-invariant voltages, said voltage divider means comprising N + 1 number of discrete resistive sections having like temperature coefficients, and having resistive values in the same order of magnitude, and N number of taps between said resistive means to provide said N temperature-invariant intermediate voltages to said electrodes requiring such voltages, with each of said resistive sections being so positioned and arranged relative to said temperature patterns as to have similar spatial average temperature experiences, and connecting means for series-connecting said resistive sections between said inner conductive coating and said low-voltage terminal, whereby due to the similarity of spatial average temperature experiences of said resistive sections, the ratio of resistive values of said resistive sections and thus the ratio of the voltage drops thereacross, does not change despite variations in said temperature patterns.

4. For use in a television cathode ray tube comprising an evacuated envelope including a neck, a faceplate and a funnel having on an internal surface thereof an inner conductive coating for receiving a relatively high anode voltage said tube also having a low-voltage terminal for receiving a relatively low voltage through a base of the tube, said tube being subject to internal spatial temperature patterns fixed or varying with time which are incidental to tube warm-up and operation, an improved electron gun located in said neck and having associated therewith an external power supply for developing gun supply voltages, with said electron gun receiving supply voltages from said power supply, one of said voltages being an intermediate voltage to be applied to at least one other electrode requiring such a voltage; that is, a voltage intermediate to said relatively high and relatively low voltages to produce a focused beam of electrons, said gun comprising associated cathode means and grid means for producing a beam of electrons, and a low-aberrations, low-magnification main focus lens means for receiving electrons from said cathode means, said main focus lens means comprising at least three main focus electrodes positioned and supported by a plurality of axially oriented structural beads for establishing an electrostatic focusing field, with a last electrode of said gun; that is, the electrode nearest the faceplate, receiving said relatively high voltage through contact means with said inner conductive coating, the improvement comprising said gun having voltage divider means for producing an intermediate voltage which is temperature-invariant, said voltage divider means comprising first and second resistive sections having like temperature coefficients and having resistive values of the same order of magnitude, with each of said resistive sections being so positioned and arranged relative to said temperature patterns as to have similar average temperature experiences, and connecting means for series-connecting said first and second resistive sections between said inner conductive coating and said low voltage terminal, and means for tapping off said intermediate voltage at a point between said first and second resistive sections and applying it to said electrode requiring such voltage, whereby due to the similarity of spatial average temperature experiences of said first and second resistive sections, the ratio of resistive values of said first and second resistive sections and thus the ratio of voltage drops thereacross, does not change despite variations in said temperature patterns.

5. In a television cathode ray tube comprising an evacuated envelope including a neck, a faceplate and a funnel having on an internal surface thereof an inner conductive coating for receiving a relatively high anode voltage, said tube also having a low-voltage terminal for receiving a relatively low voltage through a base of the tube, said tube being subject to internal spatial temperature patterns fixed or varying with time which are incidental to tube warm-up and operation, and having at least one electrode therein requiring a temperature-invariant voltage intermediate to said relatively high and relatively low voltages, an improved voltage divider means for producing such a temperature-invariant voltage comprising first and second resistive sections of like temperature coefficients and having resistive values of the same order of magnitude, with said resistive sections being deposited on an inner surface of said neck and so positioned and arranged relative to said temperature patterns as to have similar average spatial temperature experiences, and connecting means for series-connecting said first and second resistive sections between said inner conductive coating and said low-voltage terminal, with means for tapping off said intermediate voltage at a point between said resistive means and applying said voltage to said electrode requiring such voltage, whereby due to the similarity of spatial average temprature experiences of said first and second resistive sections, the ratio of the resistance values of said sections and thus the ratio of voltage drop thereacross, does not change despite variations in said temperature patterns.

6. For use with a television cathode ray tube comprising an evacuated envelope including a faceplate and a funnel having on an internal surface thereof an inner conductive coating for receiving a relatively high anode voltage, said tube also having a low-voltage terminal for receiving a relatively low voltage through a base of the tube, said tube being subject to internal spatial temperature patterns fixed or varying with time which are incidental to tube warm-up and operation, and having "N" electrodes therein requiring "N" different temperature-invariant voltages intermediate to said relatively high and relatively low voltages, said N temperature-invariant voltages being produced by a voltage divider means comprising N + 1 discrete sections having like temperature coefficients and having resistance values of the same order of magnitude, with N taps to provide said N temperature-invariant intermediate voltages to said electrodes requiring such voltages, a method for positioning and arranging said discrete sections comprising said voltage divider so that said resistive sections have similar spatial average temperature experiences, the method comprising:

determining said internal spatial temperature patterns and associated isothermal lines;

positioning and arranging said discrete sections so that each lies transverse to and resistance-centered on a common isothermal line, whereby due to the similarity of spatial average temperature experiences of said resistive sections, the ratio of resistive values of said resistive sections, and thus the ratio of voltage drops thereacross does not change despite variations in said temperature patterns.

* * * * *